United States Patent [19]

Nakashima et al.

[11] Patent Number: 4,941,842

[45] Date of Patent: Jul. 17, 1990

[54] BOARD-IN TYPE CONTACT-CONNECTORS

[75] Inventors: Terumi Nakashima, Takatsukishi; Takeshi Tanaka, Minohshi, both of Japan

[73] Assignee: Nippon Acchakutanshi Seizo Kabushiki Kaisha, Osaka, Japan

[21] Appl. No.: 362,044

[22] Filed: Jun. 6, 1989

[30] Foreign Application Priority Data

Jun. 10, 1988 [JP] Japan ..... 63-77383

[51] Int. Cl.[5] ..... H01R 4/24

[52] U.S. Cl. ..... 439/399

[58] Field of Search ..... 439/389, 426

[56] References Cited

U.S. PATENT DOCUMENTS 4,191,442 3/1980 Caveney et al. ..... 439/400

4,264,118 4/1981 Nijman ..... 439/400

4,806,120 2/1989 Baker ..... 439/399

*Primary Examiner*—Joseph H. McGlynn

*Attorney, Agent, or Firm*—Antonelli, Terry, Stout & Kraus

[57] ABSTRACT

A board-in type contact-connector comprising an insulating housing, a plurality of contacts separately housed in the insulating housing. Each contact is adapted to be connected to a printed circuit board, and includes two pairs of connecting straps having wire-receiving slots, with the straps in each pair being axially oppositely directed and each pair being spaced from the other. A pair of oppositely directed crimpable tabs are provided for crimping the wire received in the wire-receiving slots, with the crimpable tabs being situated between the respective pairs of wire connecting straps.

5 Claims, 3 Drawing Sheets

BOARD-IN TYPE CONTACT-CONNECTORS

Various board-in types of contact connectors have been proposed and, for example, Japanese Utility Model publication (examined) 613090 proposes a contact-connector which, as shown in FIG. 6, has a plurality of contacts, with each contact generally designated by the reference numeral 1 including a pin-like connecting hand 2 insertable in a hole 18 of a printed circuit board 15, and a wire connecting section 3 accommodating two pairs of spaced oppositely directed connecting straps 4 wire-receiving slots 5. A plurality of the contacts 1 are individually mounted in respective recesses 7 of an insulating housing 8, wherein the pin-like connecting hands 2 projects through an opening 10 the insulating housing 8. Each recess 7 includes an opening 8 extending from the top surface to the rear side wall which has a strain relief 9 for maintaining the wire 11. the opening 8 and forced into the wire-receiving slots 5. When it is forced into the slots 5, the insulating covering 12 of the wire 11 is cut by the sides of the slots 5, therebY effecting electrical connection between the conductor 13 and the connecting straps 4.

This contact-connector has a problem in a part of the insulting covering 12 which is near a weld 17 is likely to melt by heat generated by welding and the conductor 13 is separated from the connecting straps 4, thereby causing electrical disconnection. Particularly when the connector has a relatively weak holding strength because of its small pitch such as 1.5 mm, the electrical disconnection is most likely to occur. This is a general problem facing the known board in type of contact-connectors.

Accordingly, an object of the present invention is to provide a board-in type contact-connector which withstands any mechanical load or heat, thereby maintaining the mechanical and electrical connection between the wire and the connector over a long period of use.

SUMMARY OF THE INVENTION

According to the present invention there is provided a board in type contact-connector comprising an insulating housing, a plurality of contacts separately housed in the insulating housing, each contact comprising means for connecting the contact to a printed circuit board, and two pairs of connecting straps each having wire-receiving slots, the straps in each pair being oppositely directed and the pairs being spaced from each other. A pair of oppositely directed crimpable tabs are situated between the wire connecting straps with the tabs being crimpable so as to maintain the wire received in the wire-receiving slots.

The wire connecting straps are preferably formed by bending upward bottom portions of tho respective contacts.

DETAILED DESCRIPTION OF THE PREFERRED EMBODIMENT

Figure 1:
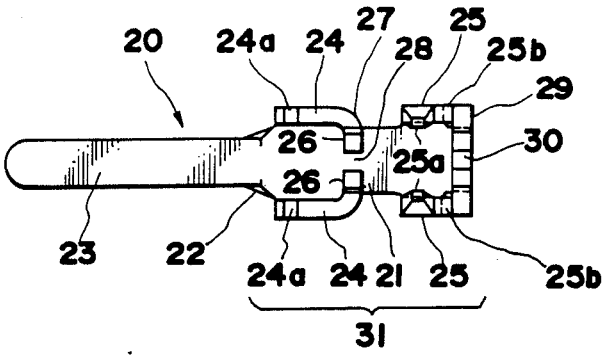
FIG. 1 is a plan view showing a contact mounted on a board-in type contact connector according to the present invention.
Figure 2:
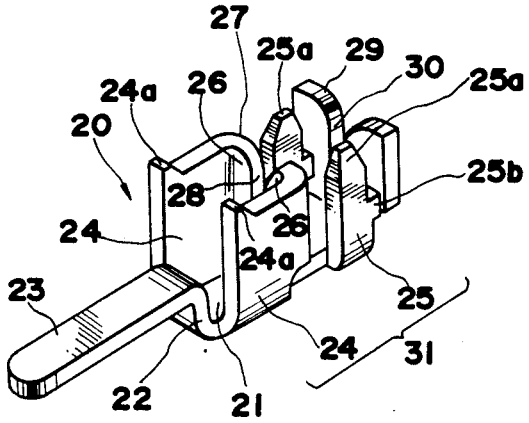
FIG. 2 is a perspective view showing the contact of FIG. 1.

Referring now to the drawings wherein like reference numerals are used throughout the various views to designate like parts and, more particularly, to FIGS. 1 and 2, according to these figures, a bore-in type contact-connector in accordance with the present invention includes a contact generally designated by the reference numeral 20 which is stamped and formed of a conductive thin material such as, for example, phosphor roms. The contact 20 includes a bottom plate 21, sidewalls 24, oppositely directed crimpable tabs 25 and each side of the bottom plate 21, and a beak portion 23 defining a first end of the contact 20 and projecting from the bottom plate 21 through a raised portion such that the beak portion is disposed in a longitudinally extending plane spaced from a longitudinally extending plane of the bottom plate 21. The sidewalls 24 are bent inwardly at rearward ends 26 so as to form a first pair of oppositely directed wire connecting straps 26 defining therebetween a wire receiving slot 28. Each sidewall 24 includes a horn 24*a* at a forward end thereof, with the horns 24*a* being engageable with an insulating housing 36 so as to define an insert depth of the contact 20 into the insulating housing 36.

The bottom plate 21 includes a second pair of oppositely directed wire connecting straps 29 axially spaced from the first pair of wire connecting straps 27 and defining a wire receiving slot 30 at a rearward end of the contact 20. The two wire-receiving slots 28, 29 are in alignment so as to enable a straight length of wire to be received therein. are located between the first wire connecting straps 27 and the second wire connecting straps 29. Each tab 25 has a top end 25*a* bent inward and an ear portion 25*b* projecting rearward which is designed to maintain the wire crimped by the tabs 25.

The first and second wire connecting straps 27, 29 and the crimpable tabs 25 constitute a wire-connecting section generally designated by the reference numeral 1.

Figure 3:
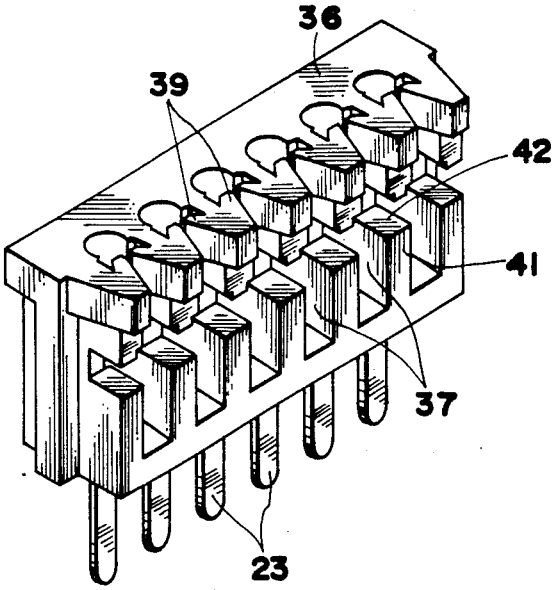
FIG. 3 is a perspective view showing a complete board-in type contact-connector having a required number of contacts.
Figure 4:
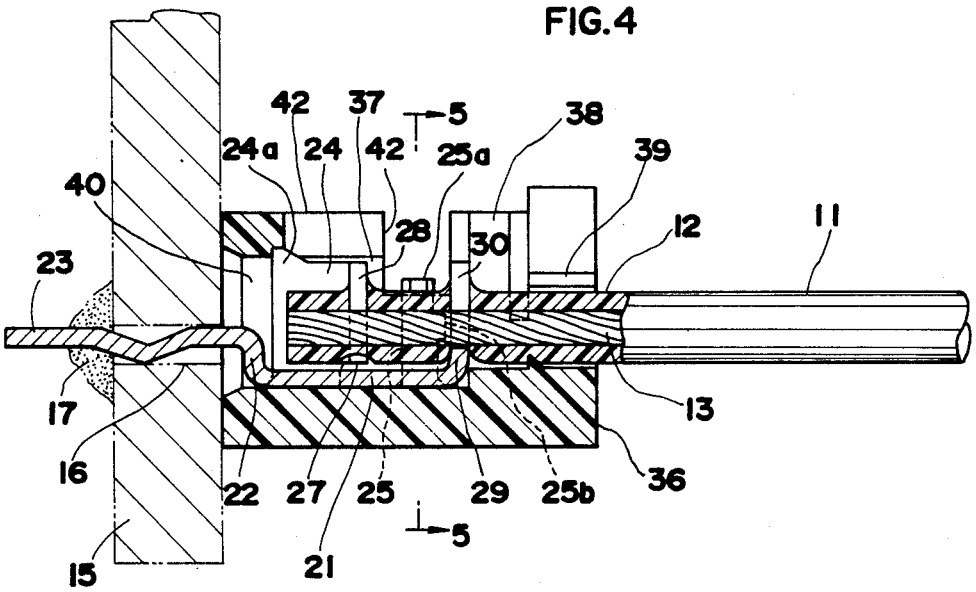
FIG. 4 is a vertical cross-section showing an assembly of a printed circuit board and the board-in type contact-connector of FIG. 3.
Figure 5:
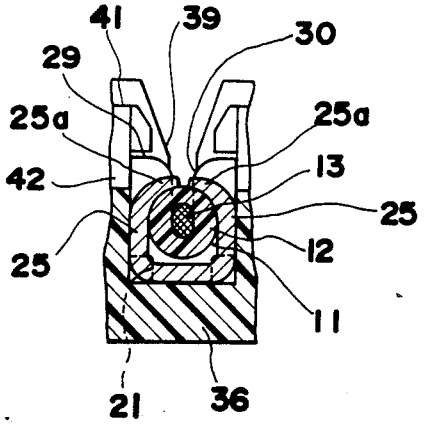
FIG. 5 is a cross-sectional view taken along the line 5—5 in FIG. 4.
Figure 6:
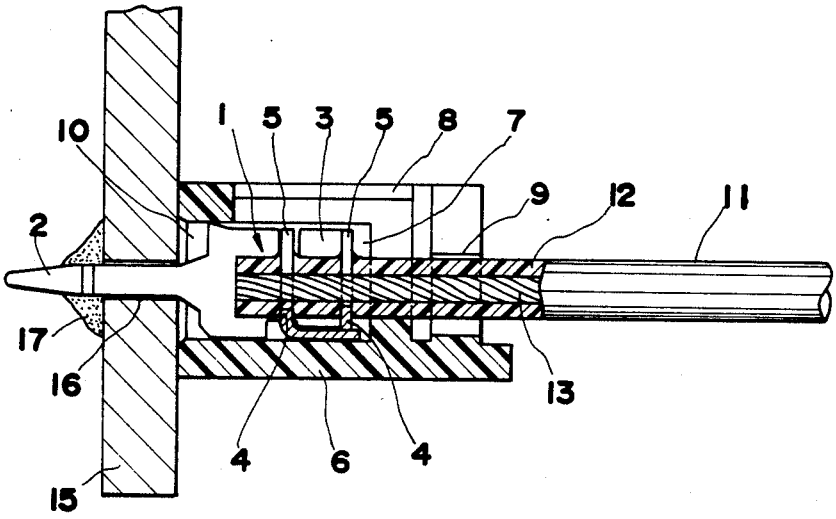
FIG. 6 is a cross-sectional view showing a known board-in type contact-connector fixed to a printed circuit board.

Each of the contacts 20, as shown in FIGS. 3 and 4, is accommodated in a recess 37 of the insulating housing 38, with its beak portion 23 extending downward. In this way the contacts 20 are housed separately from each other in the insulating housing 38.

The insulating housing 36 is made of electrically insulating plastic material such as nylon. Each recess 37 has a first opening 38 extending from the top surface of the housing 38 to the rearward side wall in which crimpable strain reliefs 39 are provided, and a second opening 40 in the forward side wall through which the beak portion 23 of each contact 20 projects downward.

The wire 11 is inserted through the first opening 38 into the recess 37 and forced into the wire-receiving slots 28 and 30 of the wire connecting strap 27 and 29. When the wire 11 is forced into the slots 28 and 30, the insulating covering 12 is cut to effect electrical connection between the conductor 13 in the wire 11 and the contact 20. When the wire 11 is forced into the slots 28 and 30, the crimpable tabs 25 are crimped over the wire 11 with the top ends 25*a* pressed on the insulating covering 12 and the ear portions 25*b* kept in abutment with the sides of the wire 11. In this way the ire 11 is secured in the contact 20. The tabs 25 are bent in the known manner at the same time when the wire 11 is forced into the wire-receiving slots 28 and 30 without requiring an extra process.

As is evident from the foregoing description, the board in type contact-connectors of the present invention ensures that the wire 11 is firmly maintained in the contacts 20 against any mechanical load because of the disposition of the crimpable tabs between the connecting straps. The contact-connector of the invention is particularly advantageous when it has such a small pitch as 1.5 mm to hold thin wires.

What is claimed is:

1. A board-in type contact-connector comprising:

an insulating housing means including a plurality of recess means;

a pluarlity of contacts adapted to be separately received in the recess means of said insulating housing means, each of said contacts including a bottom plate, a beak portion defining a first end of the contact adapted to be received in a printed circuit board, said beak portion projecting from the bottom plate through a raised portion whereby said beak portion is disposed in a longitudinally extending plane spaced from a longitudinally extending plane of the bottom plate, spaced sidewalls provided on respective sides of the bottom plate in an area of the raised portion, and wire connecting means for connecting a wire to the contact including a first pair of oppositely disposed spaced contacting strap means respectively provided on said sidewalls at a position axially spaced from said raised portion for defining a first wire-receiving slot, a second pair of oppositely disposed spaced connecting strap means disposed on said bottom plate for defining a second end of the contact and a second wire receiving slot aligned with said first wire receiving slot, and a pair of oppositely disposed spaced tab means provided on respective sides of said bottom plate interposed between and axially spaced from said first and second paris of connecting strap means, said tab means being adapted to be crimped so as to crimp the wire received in the first and second wire-receiving slots, and wherein means are provided on said tab means for preventing an application of a mechanical load on the wire thereby insuring a firm connection between the wire and the contact.

2. A board-in type contact-connector as set forth in claim 1, wherein the tab means are integrally formed upwardly bent portions of the bottom plate.

3. A board-in type contact-connector as set forth in claim 2, wherein said means for preventing an application of a mechanical load includes bent ear portions respectively provided on said tab means and extending in a direction of the second end of the contact, said ear portions being adapted to abuttingly engage the wire and maintain the wire in a secured position relative to the contact.

4. A board-in type contact-connector as set forth in claim 3, wherein means are provided on each of said side walls for engagingly abutting a portion of the housing means when the contact is received in the recess means thereby defining an insertion depth of the contact in the recess means.

5. A board-in type contact-connector as set forth in claim 4, wherein said means for engagingly abutting includes a projecting horn portion provided on each of the side walls at an upper surface thereof, said projecting horn portions being disposed on said sidewalls at a position opposite said first pair of connecting strap means.

* * * * *